US005359782A

United States Patent [19]

Langmaid

[11] Patent Number: 5,359,782

[45] Date of Patent: Nov. 1, 1994

[54] COMPOUND SLIDING BEVEL SQUARE

[76] Inventor: Jonathan C. Langmaid, P.O. Box 705, Yarmouth, Me. 04096

[21] Appl. No.: 132,105

[22] Filed: Oct. 5, 1993

[51] Int. Cl.[5] ..... B43L 7/10

[52] U.S. Cl. ..... 33/415; 33/456; 33/465; 33/473; 33/495

[58] Field of Search ..... 33/415, 416, 417, 452, 33/455, 456, 464, 465, 468, 471, 472, 473, 481, 495, 496, 497, 1 N

[56] References Cited

U.S. PATENT DOCUMENTS

| | | | |
|---|---|---|---|
| 640,194 | 1/1900 | Griswold | 33/473 |
| 707,461 | 8/1902 | Stedman | 33/455 |
| 1,222,959 | 4/1917 | Longley | 33/416 |
| 1,691,801 | 11/1928 | Fothergill | 33/415 |

*Primary Examiner*—William A. Cuchlinski, Jr.
*Assistant Examiner*—Alvin Wirthlin
*Attorney, Agent, or Firm*—William B. Ritchie

[57] ABSTRACT

An apparatus for measuring compound angles. This apparatus makes use of the standard T-bevel square, which is capable of measuring only a single angle. The invention is a compound angle blade with a split collet joint. The compound blade attaches by replacing the bolt of the T-bevel with fastening means attached to the split collet joint of the invention. This fastening means secures both the compound angle blade and the standard T-bevel square blade. The split collet joint which is attached perpendicularly to the main body of the T-bevel moves in a 360 degree radius parallel to the main body of the T-bevel. The compound angle blade is capable of rotation in approximately a 180 degree radius relative to the split collet joint. The combination of the rotation of the split collet joint and the compound angle blade allows for compound angle measurements both perpendicular and askew relative to the angle of the standard T-bevel. The angles of both blades are fixed by the same fastening action.

7 Claims, 2 Drawing Sheets

COMPOUND SLIDING BEVEL SQUARE

BACKGROUND OF THE INVENTION

1. Field of the Invention

The invention relates to bevel squares and in particular an improvement on the standard T-bevel square for use in measuring compound angles.

2. Description of the Related Art

T-bevel squares are well known in the art as a tool for measuring and verifying angles. This tool can be used to transfer an accurate angle measurement from a large-scale drawing directly to a project surface, or to take measurements and verify angles of a project surface. A T-bevel is composed basically of two pieces, the stock and the sliding adjustable blade. The sliding adjustable blade has a slot and is capable of movement relative to the stock by means of rotation on a bolt secured through the stock. A locknut or other similar locking device secures the adjustable blade in the desired position relative to the stock. U.S. Pat No. 1,691,801, a 1928 patent, discloses the standard T-bevel square with one of the most recent improvements in the art. This patent discloses a T-bevel in which the blade is pivotal and the shank is mounted within a grove located on the blade with a means provided to secure the shank in any desired position within the same plane as the blade.

However, there are some situations where it is necessary to determine compound angles in a single measurement. The typical roof valley construction is included among these cases. The T-bevel square is limited in the fact that it is only capable of measuring a single angle at a time as the adjustable blade is not capable of measuring angles in a plane that is not essentially parallel to the plane of the handle. This is not an effective means for determining angles when compound angle measurements are involved. However, there is nothing in the prior art which is capable of measuring or verifying compound angles.

SUMMARY OF THE INVENTION

It is an object of the invention to provide a T-bevel capable of measuring compound angles.

It is another object of the invention to provide a T-bevel capable of measuring compound angles which is simple to use.

It is still another object of the invention to provide a T-bevel capable of measuring compound angles which is relatively inexpensive to produce.

It is still another object of the invention to provide a compound T-bevel construction utilizing a standard T-bevel.

The invention is a compound T-bevel square. A T-bevel body, and a first angle measuring blade are provided. Means for securing said first angle measuring blade to said T-bevel body are provided, wherein said first blade is capable of rotation independent of rotation of said securing means and said means are capable of rotation along the axis parallel to said T-bevel body. A second angle measuring blade is provided. Means for securing said second angle measuring blade to said T-bevel body are provided, wherein said second blade is capable of rotation along the plane parallel to said T-bevel body.

DETAILED DESCRIPTION OF THE INVENTION

Figure 1:
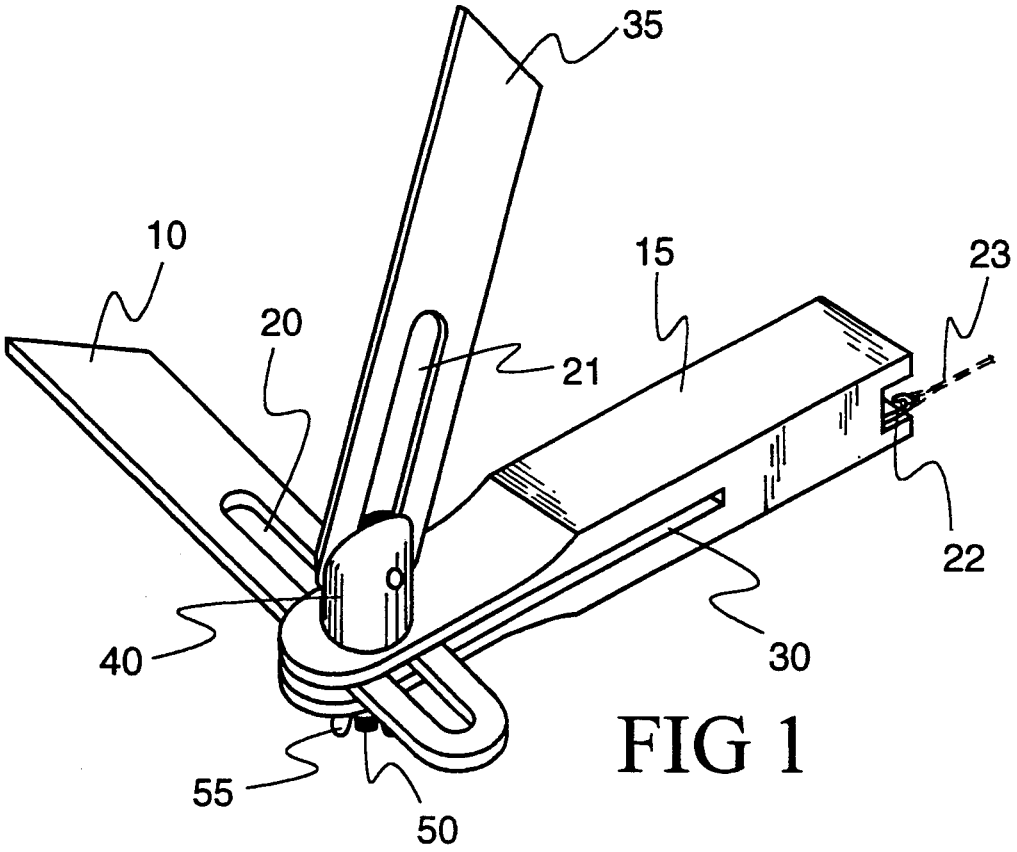
FIG. 1 is an isometric view of the compound T-bevel square.

FIG. 1 is an isometric view of the compound T-bevel square. Sliding adjustable blade 10 is shown in a fully extended position. Sliding adjustable blade 10 is capable of movement along the same plane relative to stock (handle) 15. Sliding blade interior 20, a slotted portion approximately half the length of the sliding adjustable blade 10, rests on bolt 50 which passes through a slotted portion 30 of stock 15. This manner of attachment allows for extension or retractation in length of sliding adjustable blade 10 by movement of sliding blade interior 20 along bolt 50. It also allows for storage of sliding adjustable blade 10 within slotted portion 30 of stock 15.

Compound blade 35 is attached to stock 15 by split collet joint 40 and secured with wing nut 55.

Hook 22 is provided in a recess so that the user can place string 23 on hook 22 aligned with the surface of stock 15, thus serving to extend the straightedge provided by stock 15 as required.

Figure 2:
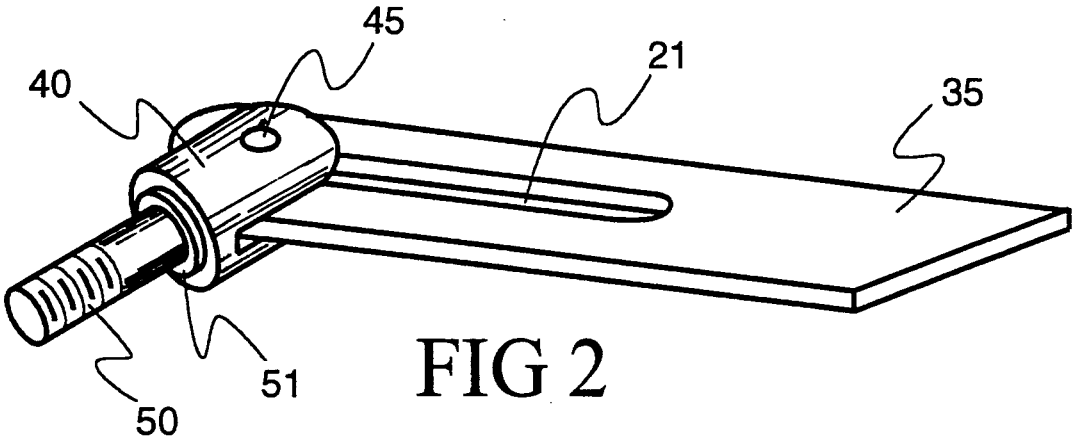
FIG. 2 is an isometric view of the compound blade and the split collet joint.

FIG. 2 is an isometric view of compound blade 35 and split collet joint 40. Compound blade 35 is secured to joint 40 by means of joint pin 45. Joint pin 45 secures compound blade 35 to split collet joint 40 while still allowing for free rotation of movement, preferably within 180 degrees along the same plane as the length of split collet joint 40. Bolt 50 attached to end of split collet joint 40 opposing compound blade 35 is of sufficient length to pass through stock 15 and is secured by means of locknut fastener 55 or other appropriate fastening means. This method of attachment places the length of joint 40 perpendicular to stock 15, and allows for the free rotation of joint 40 within 360 degrees along the plane parallel to stock 15. The combination of the rotation of the joint 40 and the compound blade 35 allows for movement of the compound blade 35 to be perpendicular as well as at any preselected angle to the rotation of sliding adjustable blade 10 thus, compound blade 35 delineates a conical section corresponding to all possible positions of blade 35, with the axis of the conical section substantially perpendicular to a plane corresponding to all possible positions resulting from pivoting sliding adjustable blade 10. The axis of the conical section is substantially centered within opening 49. This combination of movement between the two blades allows the user to set blades at appropriate angles for use with compound angle projects.

As shown blade 35 is slotted via slot 21. This option allows the length of blade 35 to be adjusted within joint 40.

Once the sliding adjustable blade 10 and compound blade 35 have been positioned to the desired angles they are secured in place. Sliding adjustable blade 10 is fixed when locknut fastener 55 is tightened by rotation of the locknut fastener 55 in a clockwise direction. When locknut fastener 55 is tightened, the sides of slotted portion of stock 15 are compressed together, preventing movement of sliding adjustable blade 10. Compound blade 35 is simultaneously fixed by the tightening of locknut fastener 55.

Figure 3:
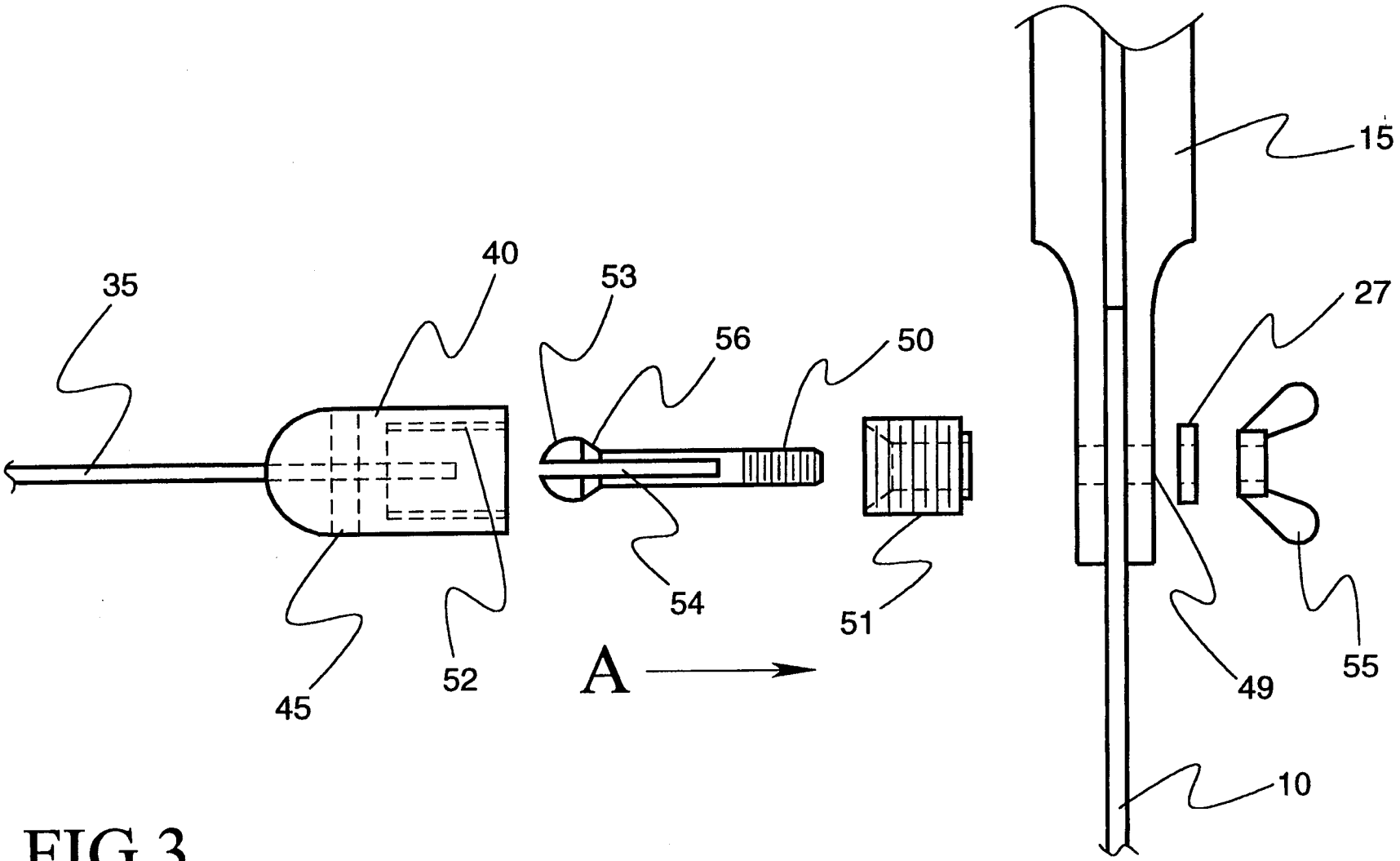
FIG. 3 is an exploded detailed view of the split collet joint in accordance with the invention.

This is demonstrated in FIG. 3 which is a detailed view of joint 40. When locknut fastener 55 is tightened against washer 27, bolt 50 is pulled toward stock 15 in the direction of arrow A. Compression shoulder 56 of bolt 50 is in turn pulled against collar 51. Collar 51 is held into compression housing 47 via threads 52 in recess 48. The end of blade 35 is inserted into slot 54. By tightening nut 55, blade 35 is held tightly in split collet 53. The angle of blade 35 between one edge and stock 15 as well as the rotational angle of blade 15 about the longitudinal axis (coincident with the direction of arrow A) of bolt 50 can be fixed simultaneously. When nut 55 is loosened, blade 35 and blade 10 can be readjusted as desired.

This invention can also be used to alter a standard T-bevel. To accomplish this, the bolt in the standard T-bevel is removed and the compound blade with joint 40 is introduced. The bolt 50 of joint 40 is first fed through first half of slotted portion of stock 15 and then through slotted portion of sliding adjustable blade 10 and finally through the second half of slotted portion of stock 15. The bolt is then secured with locknut or other fastener.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. 1. A compound angle measuring apparatus comprising:

a first blade having a slot;

a handle with a slotted mounting opening at one end and with a round opening perpendicular to the slotted mounting opening, said first blade selectively pivotally mounted within the slotted mounting opening of said handle; wherein the selectively pivotal positions of said first blade forming a planar surface;

a second blade;

mounting means, attached to said handle through the round opening, for selectively rotatably mounting said second blade to said handle;

wherein the selectively rotatable positions of said second blade forming a conical section, with the conical section having an axis substantially perpendicular to said plane and coincident to said round opening;

locking means, within said mounting means, for simultaneously releasably fixing the position of said first blade within the plane and fixing the position of said second blade within the section of the cone such that a predetermined angle of said second blade can be set relative to said plane and at a predetermined angular rotation about the axis of said round opening within said handle.

2. The apparatus of claim 1, wherein said locking means further comprises;

a compression housing having a threaded recess and rotatably attached to said second blade such that an end of said second blade protrudes into the recess of said housing;

a bolt having a split collet with a compression shoulder at one end, a shaft, and threads at the other end;

a threaded collar with an opening dimensioned in accordance with the threads of said threaded recess and said collar having an opening dimensioned so that the shaft of said bolt is free to slide therethrough;

a nut with threads corresponding to the threads at the end of said bolt; wherein said bolt is fed through said collar which is threaded into said compression housing such that the end of the second blade protruding into said recess is fitted within the slot of said split collet and said compression shoulder of said collet contacts said collar and when said bolt is also fed through said mounting opening of said handle and the slot of said first blade such that when said nut is tightened both the first blade and the second blade are releasably fixed in position.

3. The apparatus of claim 2 wherein said second blade further comprises a slot.

4. The apparatus of claim 3 wherein said handle further comprises a recess with a hook located therein.

5. A compound angle blade apparatus for use with a T-bevel having a planar blade and an adjustment bolt to adjust the position of said planar blade, said apparatus comprising:

an angle measuring blade;

compression mounting means for selectively rotatably mounting said angle measuring blade to said T-bevel, wherein the selectively rotatable positions of said angle measuring blade are independent of the pivoting of the planar blade of said T-bevel and wherein the selectively rotatable positions of said angle measuring blade rotate to form a conical section having an axis that is perpendicular to a plane formed by adjusting the planar blade of said T-bevel;

locking means, within said mounting means, for simultaneously releasably fixing the position of said planar blade and the position of said angle measuring blade.

6. The apparatus of claim 5, wherein said compression mounting means further comprises;

a compression housing having a threaded recess and rotatably attached to said angle measuring blade such that an end of said angle measuring blade protrudes into the recess of said housing;

a bolt having a slot and a compression shoulder at one end, a shaft, and threads at the other end;

a threaded collar with an opening dimensioned in accordance with the threads of said threaded recess and said collar having an opening dimensioned so that the shaft of said bolt is free to slide therethrough;

a nut with threads corresponding to the threads at the end of said bolt; wherein said bolt is fed through said collar which is threaded into said compression housing such that the end of the angle measuring blade protruding into said recess is fitted within the slot of said bolt and said compression shoulder of said bolt contacts said collar and when said bolt is also fed through said T-bevel replacing the adjustment bolt of said T-bevel such that when said nut is tightened both the angle measuring blade of the apparatus and the planar blade of said T-bevel are releasably fixed in position.

7. The apparatus of claim 6 wherein said angle measuring blade further comprises a slot.

* * * * *